US011488524B2

(12) United States Patent
Pyun et al.

(10) Patent No.: US 11,488,524 B2
(45) Date of Patent: Nov. 1, 2022

(54) ORGANIC LIGHT EMITTING DIODE DISPLAY DEVICE, AND METHOD OF OPERATING AN ORGANIC LIGHT EMITTING DIODE DISPLAY DEVICE

(71) Applicant: Samsung Display Co., Ltd., Yongin-Si (KR)

(72) Inventors: Kihyun Pyun, Gwangmyeong-si (KR); Geonhwi Park, Anyang-si (KR); Jungeon An, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/380,243

(22) Filed: Jul. 20, 2021

(65) Prior Publication Data

US 2022/0215798 A1 Jul. 7, 2022

(30) Foreign Application Priority Data

Jan. 4, 2021 (KR) ..... 10-2021-0000554

(51) Int. Cl.
*G09G 3/3208* (2016.01)
*G09G 3/20* (2006.01)

(52) U.S. Cl.
CPC ..... *G09G 3/3208* (2013.01); *G09G 3/2096* (2013.01); *G09G 2320/0233* (2013.01); *G09G 2320/0266* (2013.01); *G09G 2330/021* (2013.01); *G09G 2340/0435* (2013.01); *G09G 2360/16* (2013.01)

(58) Field of Classification Search
CPC ... G09G 3/32–3291; G09G 2340/0435; G09G 2360/16
See application file for complete search history.

(56) References Cited

U.S. PATENT DOCUMENTS 11,107,397 B2 * 8/2021 Sung ..... G09G 3/3225
11,170,691 B2 * 11/2021 Pyun ..... G09G 3/20
2014/0225817 A1 * 8/2014 Huang ..... G09G 3/3677 345/87

(Continued)

FOREIGN PATENT DOCUMENTS

KR 100590271 B1 6/2006
KR 101142637 B1 5/2012

(Continued)

*Primary Examiner* — Patrick F Marinelli
(74) *Attorney, Agent, or Firm* — Cantor Colburn LLP

(57) ABSTRACT

An organic light emitting diode ("OLED") display device, which operates in a variable frame mode, includes a display panel including a plurality of pixels, a power management circuit which supplies a power supply voltage to the plurality of pixels, and a controller which determines a panel load, a first representative gray level and a second representative gray level by analyzing input image data, determines an initial level of the power supply voltage based on the panel load and the first representative gray level, and determines a step level of the power supply voltage based on the panel load and the second representative gray level. The power management circuit generates the power supply voltage having the initial level during an active period, and gradually increases a voltage level of the power supply voltage from the initial level based on the step level during a variable blank period.

20 Claims, 12 Drawing Sheets

(56) References Cited

U.S. PATENT DOCUMENTS

| | | | | |
|---|---|---|---|---|
| 2015/0262541 | A1* | 9/2015 | Lai | G09G 3/3611 345/212 |
| 2017/0303423 | A1* | 10/2017 | Cavallaro | G02F 1/133305 |
| 2020/0152121 | A1* | 5/2020 | Sung | H02M 3/158 |
| 2020/0394966 | A1* | 12/2020 | Lim | G09G 3/3688 |
| 2021/0319740 | A1* | 10/2021 | Pyun | G09G 3/20 |
| 2022/0028332 | A1* | 1/2022 | Choi | H04N 5/63 |

FOREIGN PATENT DOCUMENTS

| | | | |
|---|---|---|---|
| KR | 1020180010351 | A | 1/2018 |
| KR | 1020180062048 | A | 6/2018 |
| KR | 1020180081320 | A | 7/2018 |
| KR | 1020190142791 | A | 12/2019 |

* cited by examiner

FIG. 5

| PANEL LOAD | MAXIMUM GRAY LEVEL | INITIAL VOLTAGE CODE |
|---|---|---|
| PLOAD1 | MGRAY1 | IVCODE11 |
| | MGRAY2 | IVCODE12 |
| | ⋮ | ⋮ |
| | MGRAYM | IVCODE1M |
| PLOAD2 | MGRAY1 | IVCODE21 |
| | MGRAY2 | IVCODE22 |
| | ⋮ | ⋮ |
| | MGRAYM | IVCODE2M |
| ⋮ | ⋮ | ⋮ |
| PLOADN | MGRAY1 | IVCODEN1 |
| | MGRAY2 | IVCODEN2 |
| | ⋮ | ⋮ |
| | MGRAYM | IVCODENM |

FIG. 6

| PANEL LOAD | AVERAGE GRAY LEVEL | STEP CODE |
|---|---|---|
| PLOAD1 | AGRAY1 | SCODE11 |
| | AGRAY2 | SCODE12 |
| | ⋮ | ⋮ |
| | AGRAYM | SCODE1M |
| PLOAD2 | AGRAY1 | SCODE21 |
| | AGRAY2 | SCODE22 |
| | ⋮ | ⋮ |
| | AGRAYM | SCODE2M |
| ⋮ | ⋮ | ⋮ |
| PLOADN | AGRAY1 | SCODEN1 |
| | AGRAY2 | SCODEN2 |
| | ⋮ | ⋮ |
| | AGRAYM | SCODENM |

FIG. 10

| PANEL LOAD | MAXIMUM GRAY LEVEL | STEP CODE |
|---|---|---|
| PLOAD1 | MGRAY1 | SCODE11 |
| | MGRAY2 | SCODE12 |
| | ⋮ | ⋮ |
| | MGRAYM | SCODE1M |
| PLOAD2 | MGRAY1 | SCODE21 |
| | MGRAY2 | SCODE22 |
| | ⋮ | ⋮ |
| | MGRAYM | SCODE2M |
| ⋮ | ⋮ | ⋮ |
| PLOADN | MGRAY1 | SCODEN1 |
| | MGRAY2 | SCODEN2 |
| | ⋮ | ⋮ |
| | MGRAYM | SCODENM |

ORGANIC LIGHT EMITTING DIODE DISPLAY DEVICE, AND METHOD OF OPERATING AN ORGANIC LIGHT EMITTING DIODE DISPLAY DEVICE

This application claims priority to Korean Patent Application No. 10-2021-0000554, filed on Jan. 4, 2021, and all the benefits accruing therefrom under 35 U.S.C. § 119, the content of which in its entirety is herein incorporated by reference.

BACKGROUND

1. Field

Embodiments of the invention relate to a display device, and more particularly to an organic light emitting diode ("OLED") display device and a method of operating the OLED display device.

2. Description of the Related Art

In general, an OLED display device may display an image at a frame frequency (or a constant frame rate) of about 60 hertz (Hz), about 120 Hz, about 240 Hz, or the like.

However, a host processor (e.g., a graphic processing unit ("GPU"), an application processor ("AP") or a graphic card) may provide frame data to the OLED display device at a frame frequency of rendering that is different from the frame frequency of the OLED display device. In particular, when the host processor provides the OLED display device with frame data (e.g., gaming image data) that is typically desired to be processed for a complicated rendering, such a frame frequency mismatch may be intensified, and a tearing phenomenon where a boundary line is caused by the frame frequency mismatch in an image of the OLED display device may occur.

To prevent or reduce such a tearing phenomenon, a variable frame mode (e.g., a Free-Sync mode, a G-Sync mode, etc.) has been developed in which a host processor provides frame data to an OLED display device at a variable frame frequency by changing a time length (or a duration of time) of a blank period in each frame period. An OLED display device supporting a variable frame mode may display an image in synchronization with the variable frame frequency, or may drive a display panel at the variable frame frequency (or a variable driving frequency), thereby reducing or preventing the tearing phenomenon.

SUMMARY

In an organic light emitting diode ("OLED") display device that operates in a variable frame mode, as a time length of a variable blank period is increased, a data voltage stored in a pixel therein may be distorted by a leakage current in the pixel, and a luminance of a display panel may be reduced. Further, as a gray level of image data is increased, the luminance of the display panel in the variable blank period may be further reduced.

Embodiments provide an OLED display device capable of preventing or reducing a luminance reduction in a variable blank period.

Embodiments provide a method of operating an OLED display device capable of preventing or reducing a luminance reduction in a variable blank period.

An embodiment of the invention provides an OLED display device which operates in a variable frame mode where a frame period includes a variable blank period. In such an embodiment, the OLED display device includes a display panel including a plurality of pixels, a power management circuit which supplies a power supply voltage to the plurality of pixels, and a controller which determines a panel load, a first representative gray level and a second representative gray level by analyzing input image data, determines an initial level of the power supply voltage based on the panel load and the first representative gray level, and determines a step level of the power supply voltage based on the panel load and the second representative gray level. In such an embodiment, the power management circuit generates the power supply voltage having the initial level during an active period of the frame period, and gradually increases a voltage level of the power supply voltage from the initial level based on the step level during the variable blank period of the frame period.

In an embodiment, the voltage level of the power supply voltage in the variable blank period may be increased as a time length of the variable blank period increases.

In an embodiment, the voltage level of the power supply voltage in the variable blank period may be periodically increased by the step level.

In an embodiment, the initial level of the power supply voltage may be increased as the panel load increases, and may be increased as the first representative gray level increases.

In an embodiment, the step level of the power supply voltage may be increased as the panel load increases, and may be increased as the second representative gray level increases.

In an embodiment, the controller may generate an initial voltage code representing the initial level of the power supply voltage and a step code representing the step level of the power supply voltage, and may generate an additional voltage code which has an initial value in the active period and periodically increases by the step code during the variable blank period. In such an embodiment, the power management circuit may receive the initial voltage code and the additional voltage code from the controller, and may generate the power supply voltage having the voltage level corresponding to a sum of the initial voltage code and the additional voltage code.

In an embodiment, the first representative gray level may be a maximum gray level of the input image data, and the second representative gray level may be an average gray level of the input image data.

In an embodiment, the controller may include a load calculation block which calculates the panel load by calculating a ratio of a sum of gray levels of the input image data to a maximum gray level sum, a maximum gray detection block which determines the maximum gray level among the gray levels of the input image data, an average gray calculation block which calculates the average gray level of the gray levels of the input image data, a voltage code generation block which generates an initial voltage code representing the initial level corresponding to the panel load and the maximum gray level, a step code generation block which generates a step code representing the step level corresponding to the panel load and the average gray level, and a blank counter block which counts clock pulses during the variable blank period, and to generate an additional voltage code which is increased by the step code each time when a number of the counted clock pulses is increased by a predetermined number.

In an embodiment, the controller may further include an initial voltage code lookup table which stores a plurality of initial voltage codes corresponding to a plurality of first combinations of panel loads and maximum gray levels, and a step code lookup table which stores a plurality of step codes corresponding to a plurality of second combinations of the panel loads and average gray levels. The voltage code generation block may output the initial voltage code corresponding to the panel load calculated by the load calculation block and the maximum gray level determined by the maximum gray detection block among the plurality of initial voltage codes stored in the initial voltage code lookup table, and the step code generation block may output the step code corresponding to the panel load calculated by the load calculation block and the average gray level calculated by the average gray calculation block among the plurality of step codes stored in the step code lookup table.

In an embodiment, the power management circuit may include a power supply voltage digital-to-analog converter ("DAC)" block which calculates a sum of the initial voltage code and the additional voltage code, and generates an analog voltage corresponding to the sum of the initial voltage code and the additional voltage code, and a power supply voltage generation block which generates the power supply voltage based on the analog voltage received from the power supply voltage DAC block.

In an embodiment, each of the first representative gray level and the second representative gray level may be a maximum gray level of the input image data.

In an embodiment, the controller may include a load calculation block which calculates the panel load by calculating a ratio of a sum of gray levels of the input image data to a maximum gray level sum, a maximum gray detection block which determines the maximum gray level among the gray levels of the input image data, a voltage code generation block which generates an initial voltage code representing the initial level corresponding to the panel load and the maximum gray level, a step code generation block which generates a step code representing the step level corresponding to the panel load and the maximum gray level, and a blank counter block which counts clock pulses during the variable blank period, and generates an additional voltage code which is increased by the step code each time when a number of the counted clock pulses is increased by a predetermined number.

In an embodiment, the controller may further include an initial voltage code lookup table which stores a plurality of initial voltage codes corresponding to a plurality of first combinations of panel loads and maximum gray levels, and a step code lookup table which stores a plurality of step codes corresponding to a plurality of second combinations of the panel loads and the maximum gray levels. The voltage code generation block may output the initial voltage code corresponding to the panel load calculated by the load calculation block and the maximum gray level determined by the maximum gray detection block among the plurality of initial voltage codes stored in the initial voltage code lookup table, and the step code generation block may output the step code corresponding to the panel load calculated by the load calculation block and the maximum gray level determined by the maximum gray detection block among the plurality of step codes stored in the step code lookup table.

An embodiment of the invention provides a method of operating an OLED display device which operates in a variable frame mode in which a frame period includes a variable blank period. In such an embodiment, the method includes determining a panel load, a first representative gray level and a second representative gray level by analyzing input image data, determining an initial level of a power supply voltage, which is provided to a plurality of pixels of a display panel, based on the panel load and the first representative gray level, determining a step level of the power supply voltage based on the panel load and the second representative gray level, generating the power supply voltage having the initial level during an active period of the frame period, and gradually increasing a voltage level of the power supply voltage from the initial level based on the step level during the variable blank period of the frame period.

In an embodiment, the voltage level of the power supply voltage in the variable blank period may be increased as a time length of the variable blank period increases.

In an embodiment, the voltage level of the power supply voltage in the variable blank period may be periodically increased by the step level.

In an embodiment, the gradually increasing the voltage level of the power supply voltage may include counting clock pulses during the variable blank period, and increasing the voltage level of the power supply voltage by the step level each time when a number of the counted clock pulses is increased by a predetermined number.

In an embodiment, the initial level of the power supply voltage may be increased as the panel load increases, and may be increased as the first representative gray level increases.

In an embodiment, the step level of the power supply voltage may be increased as the panel load increases, and may be increased as the second representative gray level increases.

In an embodiment, the first representative gray level may be a maximum gray level of the input image data, and the second representative gray level may be an average gray level of the input image data.

In embodiments of an OLED display device and a method of operating the OLED display according to the invention, as described herein, an initial level of a power supply voltage may be determined based on a panel load and a first representative gray level, a step level of the power supply voltage may be determined based on the panel load and a second representative gray level, and a voltage level of the power supply voltage may be gradually increased from the initial level based on the step level in a variable blank period. Accordingly, in such embodiments of the OLED display device, a luminance reduction in the variable blank period may be prevented or reduced.

BRIEF DESCRIPTION OF THE DRAWINGS

The above and other features of the invention will become more apparent by describing in further detail embodiments thereof with reference to the accompanying drawings, in which:

FIG. 5 is a diagram illustrating an embodiment of an initial voltage code lookup table that stores a plurality of initial voltage codes corresponding to a plurality of combinations of panel loads and maximum gray levels;

FIG. 6 is a diagram illustrating an embodiment of a step code lookup table that stores a plurality of step codes corresponding to a plurality of combinations of panel loads and average gray levels;

FIG. 10 is a diagram illustrating an embodiment of a step code lookup table that stores a plurality of step codes corresponding to a plurality of combinations of panel loads and maximum gray levels;

DETAILED DESCRIPTION

Figure 1:
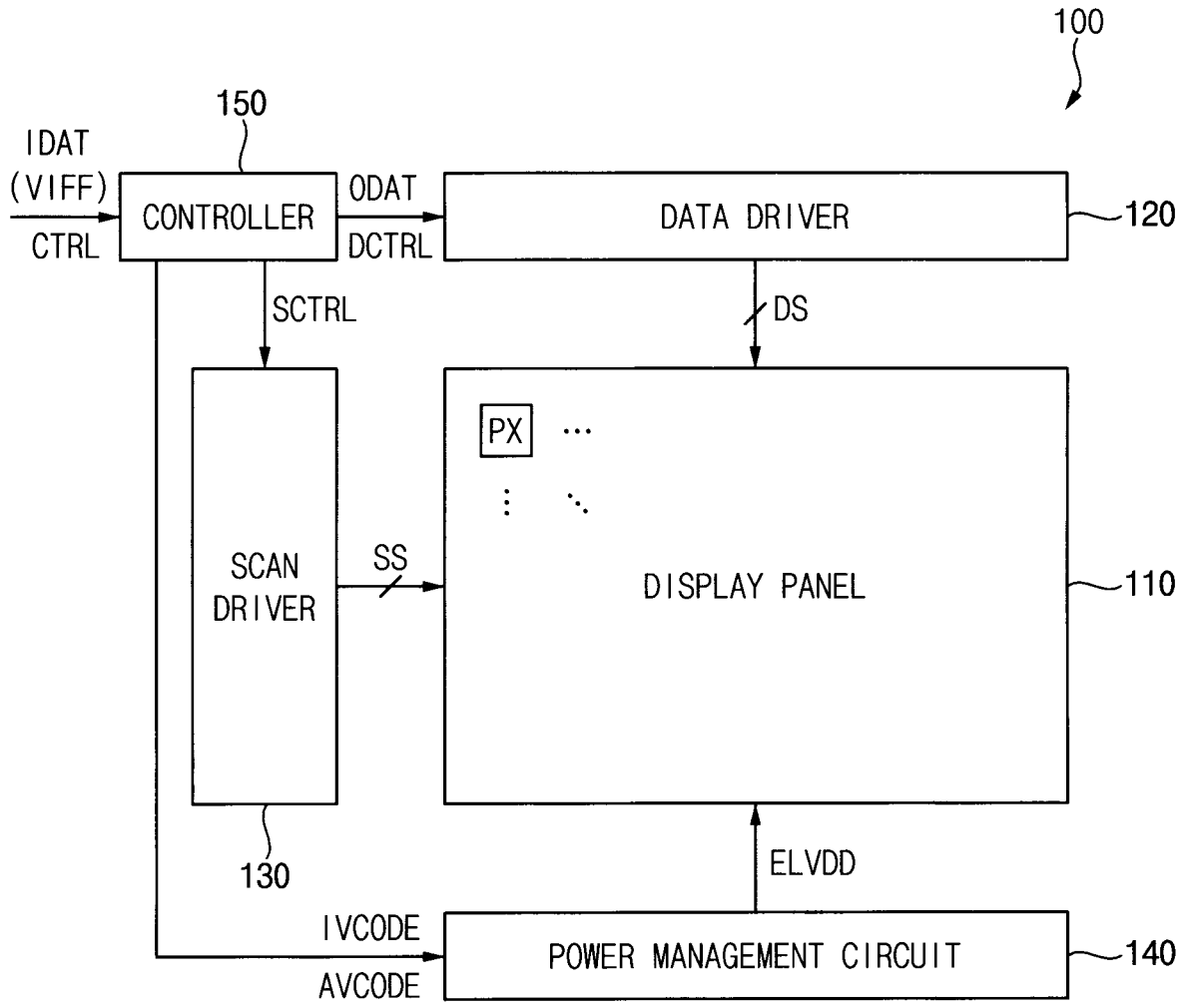
FIG. 1 is a block diagram illustrating an organic light emitting diode ("OLED") display device according to an embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

Figure 2:
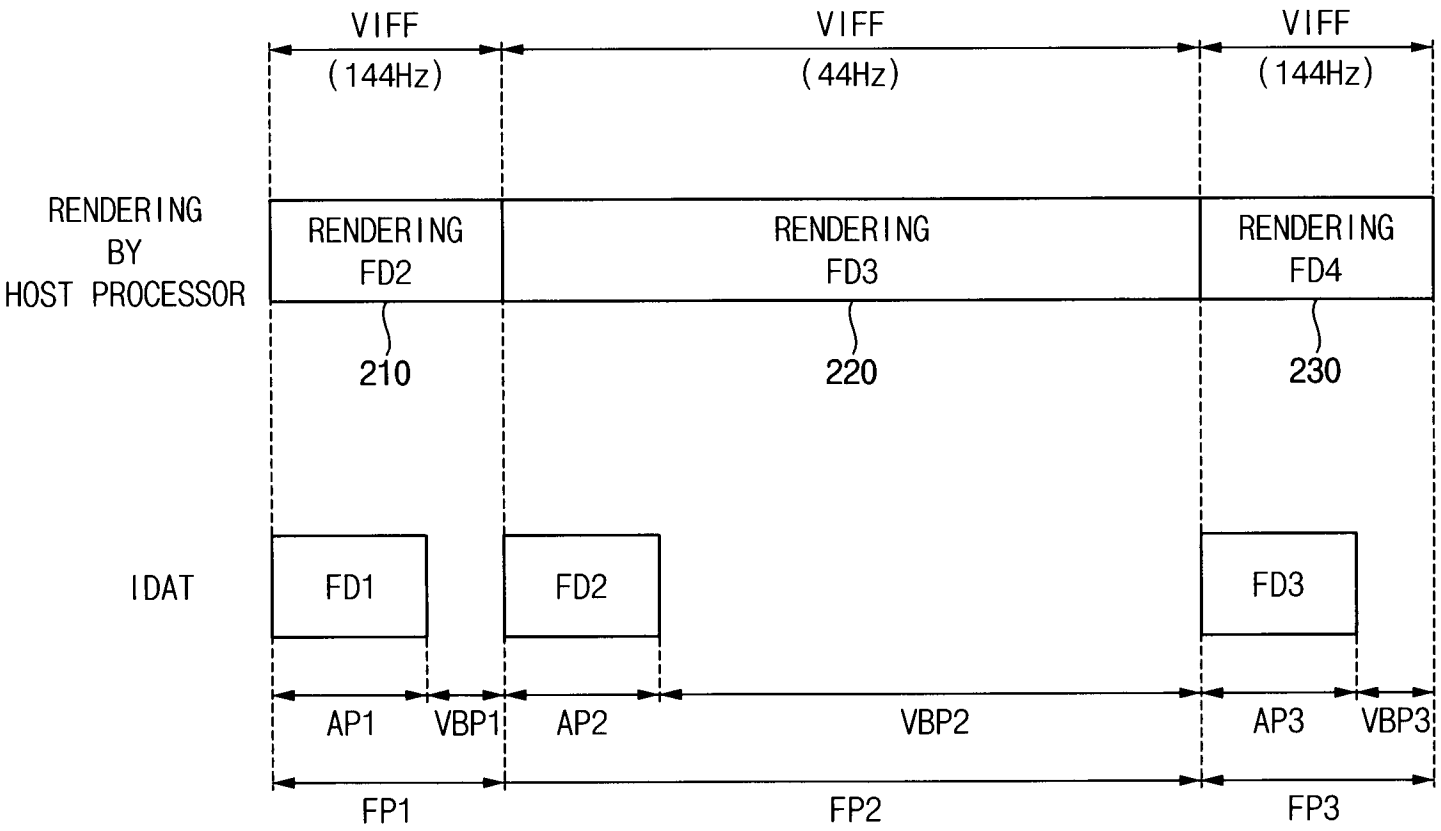
FIG. 2 is a timing diagram illustrating an embodiment of input image data that are input to an OLED display device at a variable input frame frequency.
Figure 3:
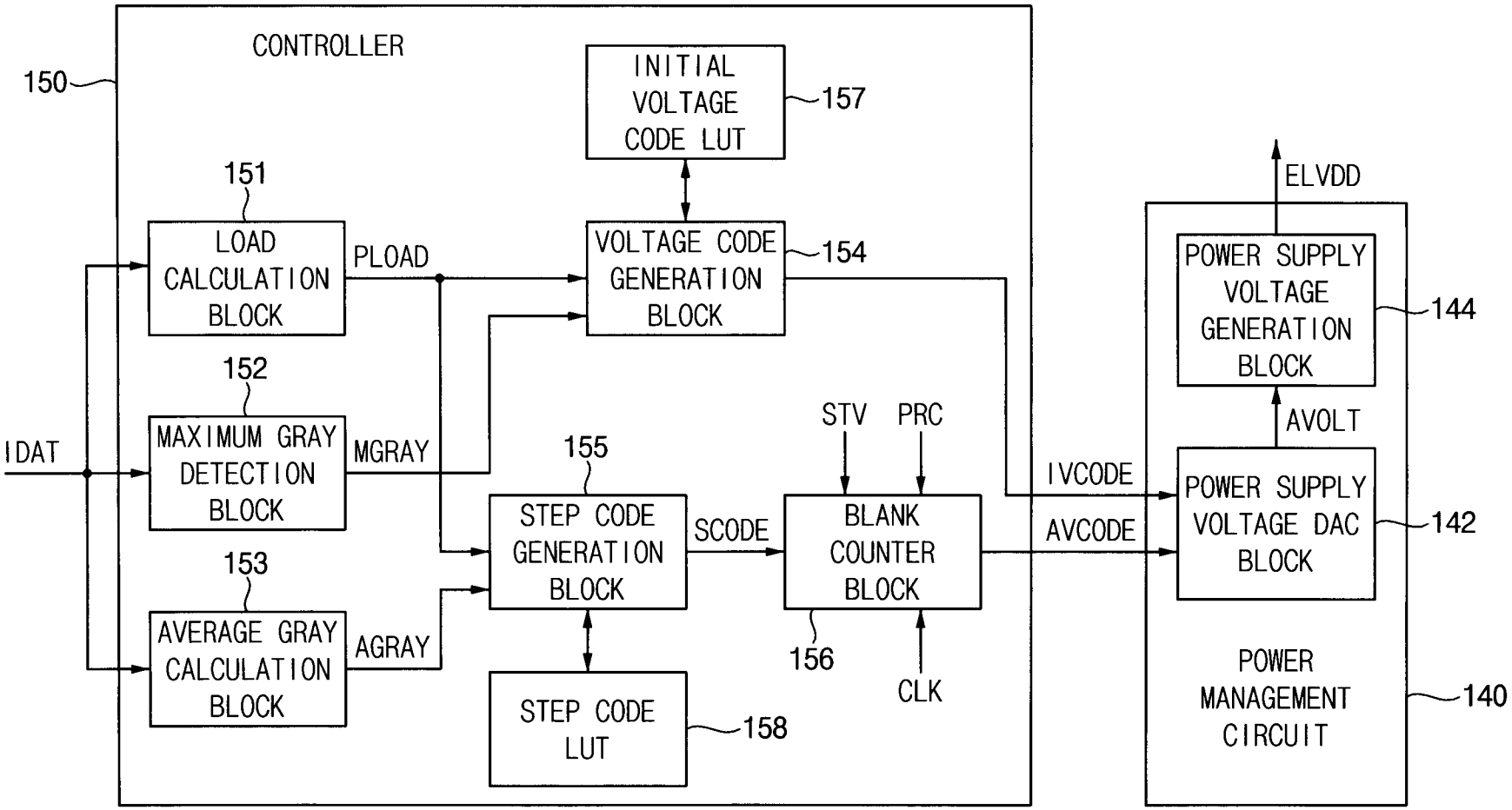
FIG. 3 is a block diagram illustrating a controller and a power management circuit included in an OLED display device according to an embodiment.
Figure 4:
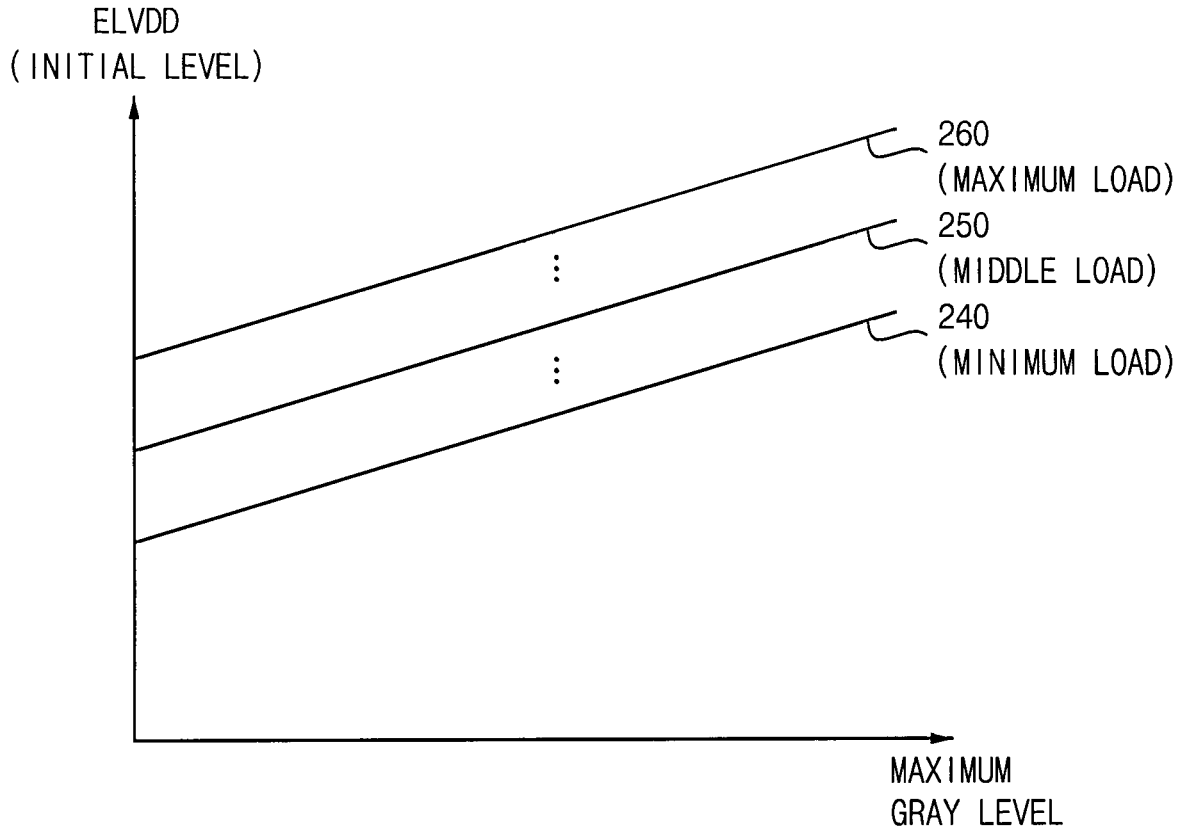
FIG. 4 is a diagram for describing an initial level of a power supply voltage that is determined according to a panel load and a maximum gray level.
Figure 7:
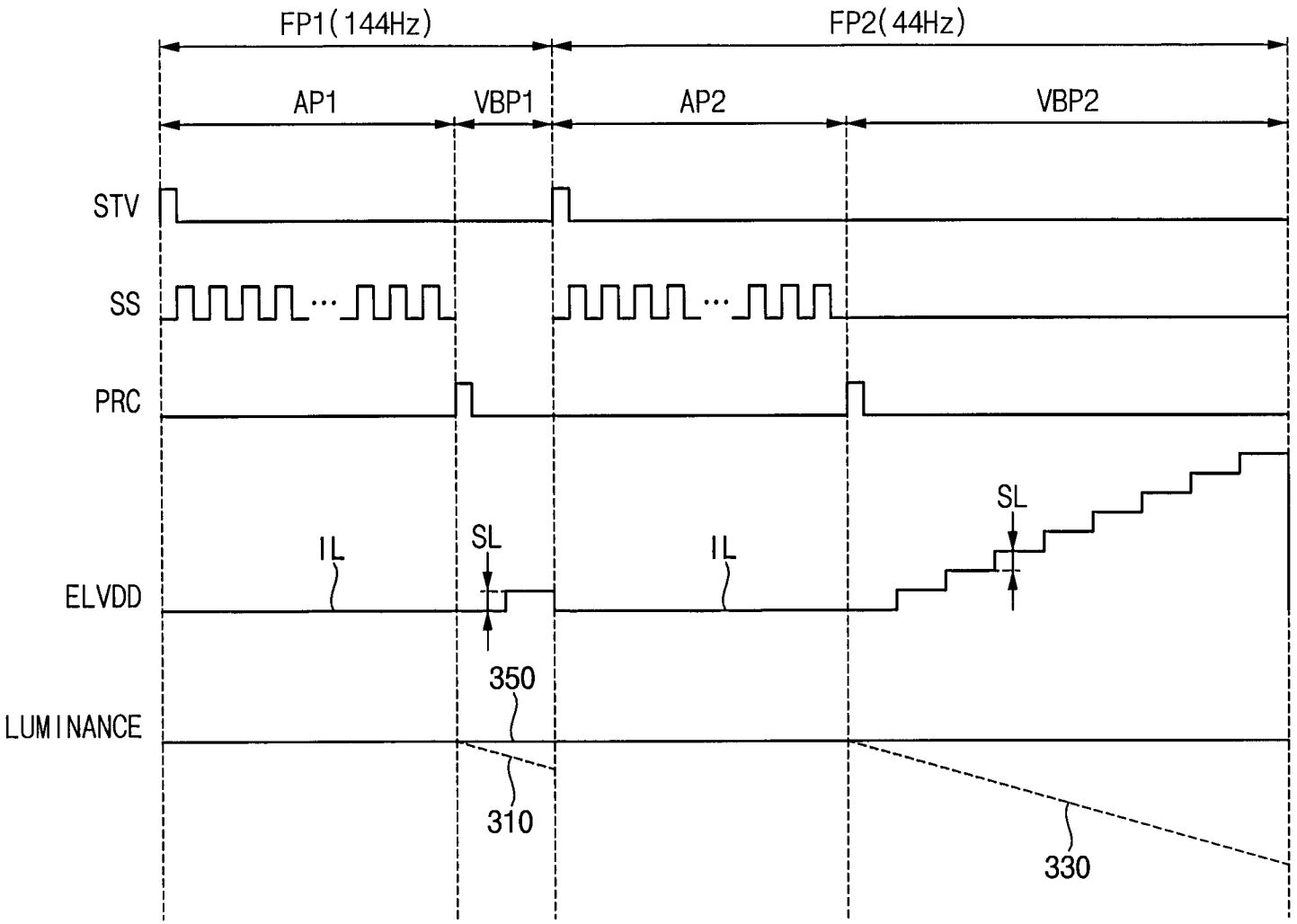
FIG. 7 is a diagram for describing an embodiment of a voltage level of a power supply voltage in frame periods corresponding to different driving frequencies.
Figure 8:
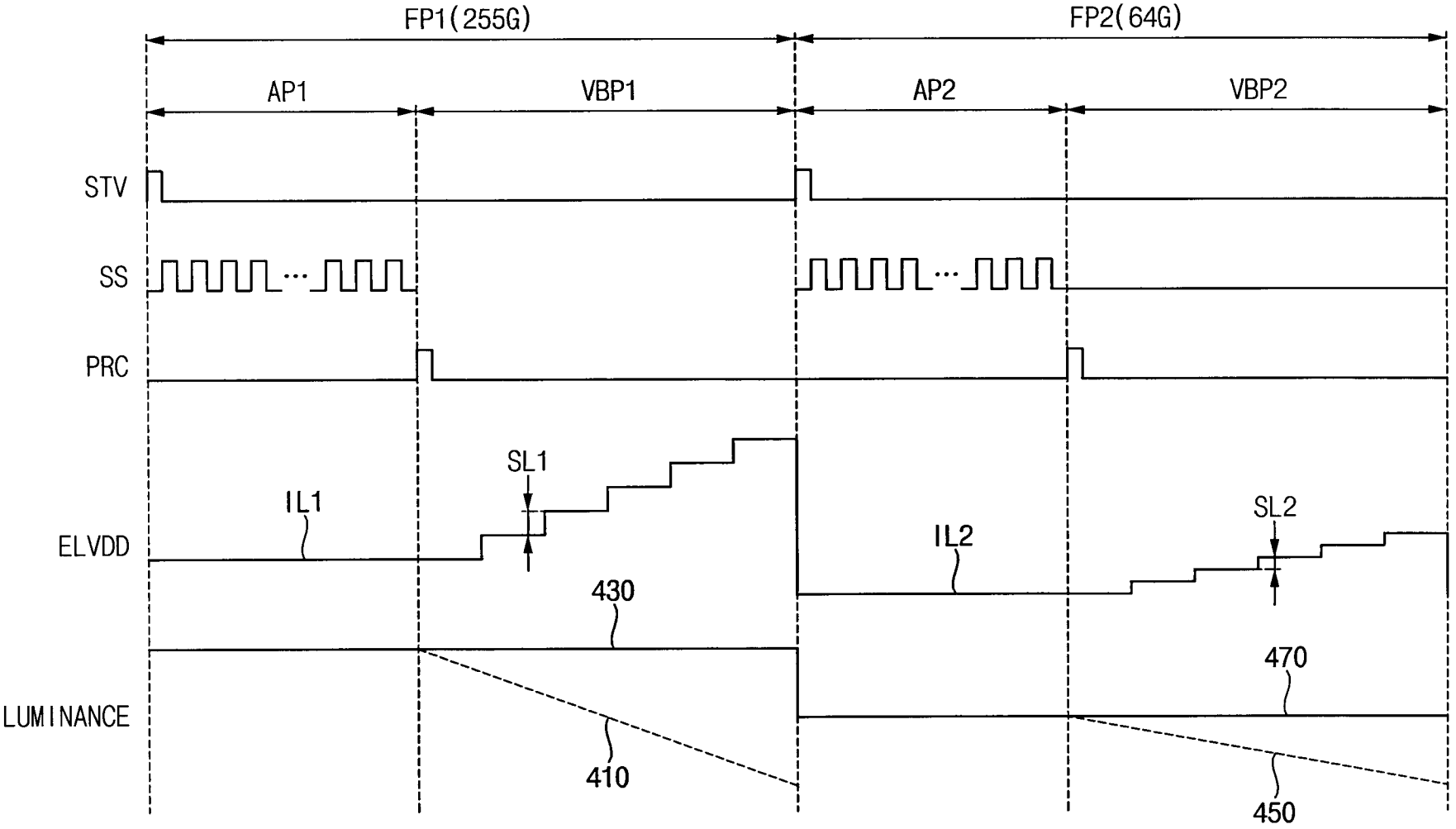
FIG. 8 is a diagram for describing an embodiment of a voltage level of a power supply voltage in frame periods in which images having different gray levels are displayed.

FIG. 1 is a block diagram illustrating an organic light emitting diode ("OLED") display device according to an embodiment, FIG. 2 is a timing diagram illustrating an embodiment of input image data that are input to an OLED display device at a variable input frame frequency, FIG. 3 is a block diagram illustrating a controller and a power management circuit included in an OLED display device according to an embodiment, FIG. 4 is a diagram for describing an initial level of a power supply voltage that is determined according to a panel load and a maximum gray level, FIG. 5 is a diagram illustrating an embodiment of an initial voltage code lookup table that stores a plurality of initial voltage codes corresponding to a plurality of combinations of panel loads and maximum gray levels, FIG. 6 is a diagram illustrating an embodiment of a step code lookup table that stores a plurality of step codes corresponding to a plurality of combinations of panel loads and average gray levels, FIG. 7 is a diagram for describing an embodiment of a voltage level of a power supply voltage in frame periods corresponding to different driving frequencies, and FIG. 8 is a diagram for describing an embodiment of a voltage level of a power supply voltage in frame periods in which images having different gray levels are displayed.

Referring to FIG. 1, an embodiment of an OLED display device 100 may include a display panel 110 including a plurality of pixels PX, a power management circuit 140 for supplying a power supply voltage ELVDD (e.g., a high power supply voltage) to the plurality of pixels PX, and a controller 150 for controlling an operation of the OLED display device 100. In an embodiment, the OLED display device 100 may further include a data driver 120 for providing data signals DS to the plurality of pixels PX, and a scan driver 130 for providing scan signals SS to the plurality of pixels PX.

The display panel 110 may include a plurality of data lines, a plurality of scan lines, and the plurality of pixels PX coupled to the plurality of data lines and the plurality of scan lines. In an embodiment, each pixel PX may include at least two transistors, at least one capacitor and a light emitting diode, such as an OLED. Each pixel PX may receive the power supply voltage ELVDD, and the light emitting diode may emit light based on a driving current provided from a line of the power supply voltage ELVDD through a driving transistor of the pixel PX.

The data driver 120 may generate the data signals DS based on output image data ODAT and a data control signal DCTRL received from the controller 150, and may provide the data signals DS to the plurality of pixels PX through the plurality of data lines. In an embodiment, the data control signal DCTRL may include, but not limited to, an output data enable signal, a horizontal start signal and a load signal. In an embodiment, the data driver 120 and the controller 150 may be implemented with a single integrated circuit, and the single integrated circuit may be referred to as a timing controller embedded data driver ("TED"). In other an embodiment, the data driver 120 and the controller 150 may be implemented with separate integrated circuits.

The scan driver 130 may generate the scan signals SS based on a scan control signal SCTRL received from the controller 150, and may sequentially provide the scan signals SS to the plurality of pixels PX on a pixel row basis through the plurality of scan lines. In an embodiment, the scan control signal SCTRL may include, but not limited to, a scan start signal and a scan clock signal. In an embodiment, the scan driver 130 may be integrated or formed in a peripheral portion of the display panel 110. In an alternative embodiment, the scan driver 130 may be implemented with one or more integrated circuits.

The power management circuit 140 may generate the power supply voltage, and may supply the power supply voltage ELVDD to the plurality of pixels PX. In some an embodiment, the power management circuit 140 may further generate a low power supply voltage supplied to the plurality of pixels PX, an analog power supply voltage supplied to the data driver 120, high and low gate voltages supplied to the scan driver 130, etc. In an embodiment, the power management circuit 140 may receive an initial voltage code IVCODE representing an initial level of the power supply voltage ELVDD and an additional voltage code AVCODE that is gradually increased in a variable blank period, may generate the power supply voltage ELVDD having the initial level represented by the initial voltage code IVCODE during an active period, and may gradually increase a voltage level of the power supply voltage ELVDD from the initial voltage based on a sum of the initial voltage code IVCODE and the additional voltage code AVCODE in the variable blank period. In an embodiment, the power management circuit 140 may be implemented with an integrated circuit, and the integrated circuit may be referred to as a power management integrated circuit ("PMIC"). In an alternative embodiment, the power management circuit 140 may be included in the controller 150.

The controller 150 (e.g., a timing controller ("TCON")) may receive input image data IDAT and a control signal CTRL from an external host processor (e.g., a graphic processing unit ("GPU"), an application processor ("AP"), or a graphic card). In an embodiment, the input image data IDAT may be RGB image data including red image data, green image data and blue image data. In an embodiment, the control signal CTRL may include, but not limited to, a vertical synchronization signal, a horizontal synchronization signal, an input data enable signal, a master clock signal, etc. The controller 150 may generate the data control signal DCTRL, the scan control signal SCTRL and the output image data ODAT based on the control signal CTRL and the input image data IDAT. The controller 150 may control an operation of the data driver 120 by providing the data control signal DCTRL and the output image data ODAT to the data driver 120, and may control an operation of the scan driver 130 by providing the scan control signal SCTRL to the scan driver 130.

In an embodiment, the OLED display device 100 may support or operate in a variable frame mode (e.g., a Free-Sync mode, a G-Sync mode, etc.) in which a frame period includes a variable blank period. In the variable frame mode, the host processor may provide the input image data IDAT to the OLED display device 100 at a variable input frame frequency VIFF (or a variable frame rate) by changing a time length (or a duration of time) of the variable blank period in each frame period, and the controller 150 of the OLED display device 100 may receive the input image data IDAT from the host processor at the variable input frame frequency VIFF. In such an embodiment, the controller 150 may control the data driver 120 and the scan driver 130 to drive the display panel 110 at the variable input frame frequency VIFF, or a variable driving frequency.

In one embodiment, for example, as illustrated in FIG. 2, the host processor (e.g., the GPU, the AP or the graphic card) may perform renderings 210, 220 and 230, and the OLED display device 100 may display rendered images in frame periods FP1, FP2 and FP3. The renderings 210, 220 and 230 performed by the host processor may not be constant or regular, for example, in a case where the host processor renders game image data. The host processor may provide the input image data IDAT, or frame data FD1, FD2, FD3 and FD4 to the OLED display device 100 in synchronization with such irregular periods of the renderings 210, 220 and 230 in the variable frame mode. In the variable frame mode, an active period AP1, AP2 and AP3 of each frame period FP1, FP2 and FP3 may have a constant time length, but the variable blank period VBP1, VBP2 and VBP3 of each frame period FP1, FP2 and FP3 may have a variable time length. In such an embodiment, the host processor may provide the frame data FD1, FD2 and FD3 to the OLED display device 100 at the variable input frame frequency VIFF by changing the time length (or the duration of time) of the variable blank period VBP1, VBP2 and VBP3.

In an embodiment of FIG. 2, if a rendering 210 for second frame data FD2 is performed at a frequency of about 144 Hz in a first frame period FP1, the host processor may provide first frame data FD1 to the OLED display device 100 at the variable input frame frequency VIFF of about 144 Hz in the first frame period FP1. In such an embodiment, the host processor may output the second frame data FD2 during an active period AP2 of a second frame period FP2, and may continue a vertical blank period VBP2 of the second frame period FP2 until a rendering 220 for third frame data FD3 is completed. Thus, in the second frame period FP2, if the rendering 220 for the third frame data FD3 is performed at a frequency of about 44 Hz, the host processor may provide the second frame data FD2 to the OLED display device 100 at the variable input frame frequency VIFF of about 44 Hz by increasing a time length of the variable blank period VBP2 of the second frame period FP2.

In a third frame period FP3, if a rendering 230 for fourth frame data FD4 is performed again at a frequency of about 144 Hz, the host processor may provide the third frame data FD3 to the OLED display device 100 again at the variable input frame frequency VIFF of about 144 Hz.

In such an embodiment, as described above, in the variable frame mode, each frame period FP1, FP2 and FP3 may include the active period AP1, AP2 and AP3 having the constant time length regardless of the variable input frame frequency VIFF, and the variable blank period VBP1, VBP2 and VBP3 having the variable time length corresponding to the variable input frame frequency VIFF. In one embodiment, for example, in the variable frame mode, the time length of the variable blank period VBP1, VBP2 and VBP3 may be increased as the variable input frame frequency VIFF decreases. In the variable frame mode, the controller 150 may receive the input image data IDAT at the variable input frame frequency VIFF, and may output the output image data ODAT to the data driver 120 at a driving frequency substantially the same as the variable input frame frequency VIFF. Accordingly, an embodiment of the OLED display device 100 that operates in or supports the variable frame mode may display an image in synchronization with the variable input frame frequency VIFF, thereby reducing or preventing a tearing phenomenon that may be caused by a frame frequency mismatch.

In such an embodiment, since the time length of the variable blank period is changed in the variable frame mode, the time length of the variable blank period may become longer than a time length of a blank period in a normal mode in which an image is displayed in a constant frame rate or a constant driving frequency. Thus, a luminance of the display panel 110 may be reduced by a leakage current in each pixel PX in the variable blank period, and an image quality may be degraded in the variable frame mode. In such an embodiment, as the variable input frame frequency VIFF is decreased, or as the time length of the variable blank period is increased, the luminance reduction in the variable blank period may be increased. In such an embodiment, as a gray level of image data IDAT and ODAT is increased, the leakage current in each pixel PX may be increased, and thus the luminance reduction in the variable blank period may be further increased.

In an embodiment of the invention, to prevent or reduce the luminance reduction in the variable blank period, the OLED display device 100 may determine a panel load, a first representative gray level and a second representative gray level by analyzing the input image data IDAT, may determine an initial level of the power supply voltage ELVDD based on the panel load and the first representative gray level, may determine a step level of the power supply voltage ELVDD based on the panel load and the second representative gray level, may generate the power supply voltage ELVDD having the initial level during an active period of each frame period, and may gradually increase a voltage level of the power supply voltage ELVDD from the initial level based on the step level in a variable blank period of the frame period. Thus, in such an embodiment of the OLED display device 100, the voltage level of the power supply voltage ELVDD in the variable blank period may be increased as the time length of the variable blank period increases. If the voltage level of the power supply voltage ELVDD is increased, a channel length modulation may be induced in a driving transistor of each pixel PX by the increased power supply voltage ELVDD, a driving current generated by the driving transistor may be increased by the channel length modulation, and a luminance of the light emitting diode in each pixel PX may be increased. Accordingly, in such an embodiment of the OLED display device 100, even if the time length of the variable blank period is increased, the luminance reduction in the variable blank period may be prevented or reduced because the voltage level of the power supply voltage ELVDD is increased.

In an embodiment, to gradually or periodically increase the voltage level of the power supply voltage ELVDD in the variable blank period, the controller 150 may generate an initial voltage code IVCODE representing the initial level of the power supply voltage ELVDD based on the panel load and the first representative gray level, may generate a step code representing the step level of the power supply voltage ELVDD based on the panel load and the second representative gray level, and may generate an additional voltage code AVCODE that has an initial value (e.g., a value of 0) in the active period and periodically increases (at a substantially constant interval) by the step code in the variable blank period. In such an embodiment, the power management circuit 140 may receive the initial voltage code IVCODE and the additional voltage code AVCODE from the controller 150, and may generate the power supply voltage ELVDD having the voltage level corresponding to a sum of the initial voltage code IVCODE and the additional voltage code AVCODE. In an embodiment, the first representative gray level may be a maximum gray level of the input image data IDAT for one frame, and the second representative gray level may be an average gray level of the input image data IDAT for the one frame. In an embodiment, as illustrated in FIG. 3, the controller 150 may include a load calculation block 151, a maximum gray detection block 152, an average gray calculation block 153, a voltage code generation block 154, a step code generation block 155 and a blank counter block 156, and the power management circuit 140 may include a power supply voltage digital-to-analog converter ("DAC") block 142 and a power supply voltage generation block 144 to perform the operations described above.

The load calculation block 151 may calculate the panel load PLOAD by calculating a ratio of a sum of gray levels of the input image data IDAT in a current frame period to a maximum gray level sum. In one embodiment, for example, the maximum gray level sum may be a sum of 255-gray levels for all the pixels PX of the display panel 110. In one embodiment, for example, the load calculation block 151 may determine the panel load PLOAD as about 100% in a case where the input image data IDAT represent 255-gray levels with respect to all the pixels PX, and may determine the panel load PLOAD as about 0% in a case where the input image data IDAT represent 0-gray levels with respect to all the pixels PX.

The maximum gray detection block 152 may determine, as the first representative gray level, the maximum gray level MGRAY among the gray levels of the input image data IDAT in the current frame period. In one embodiment, for example, in a case where the input image data IDAT represent gray levels from a 0-gray level to a 100-gray level, the maximum gray detection block 152 may determine the maximum gray level MGRAY as the 100-gray level.

The average gray calculation block 153 may calculate, as the second representative gray level, the average gray level AGRAY of the gray levels of the input image data IDAT. In one embodiment, for example, in a case where the input image data IDAT represent gray levels from a 0-gray level to a 100-gray level, and the numbers of the respective gray levels are substantially the same as each other, the average gray calculation block 153 may determine the average gray level AGRAY as about 50-gray level.

The voltage code generation block 154 may determine the initial level of the power supply voltage ELVDD based on the panel load PLOAD and the maximum gray level MGRAY, and may generate the initial voltage code IVCODE representing the initial level corresponding to the panel load PLOAD and the maximum gray level MGRAY. In an embodiment, the initial level of the power supply voltage ELVDD may be increased as the panel load PLOAD increases, and may be increased as the first representative gray level, or the maximum gray level MGRAY increases. In one embodiment, for example, as illustrated in FIG. 4, the initial level of the power supply voltage ELVDD may be determined based on a first voltage level line 240 in a case where the panel load PLOAD is a minimum load (e.g., about 0%), may be determined based on a second voltage level line 250 higher than the first voltage level line 240 in a case where the panel load PLOAD is a middle load (e.g., about 50%), and may be determined based on a third voltage level line 260 higher than the second voltage level line 250 in a case where the panel load PLOAD is a maximum load (e.g., about 100%). In such an embodiment, each voltage level line 240, 250 and 260 may have a higher voltage level as the maximum gray level MGRAY increases.

In an embodiment, the controller 150 may further include an initial voltage code lookup table (LUT in FIG. 3) 157 that stores a plurality of initial voltage codes corresponding to a plurality of first combinations of panel loads and maximum gray levels, and the voltage code generation block 154 may output the initial voltage code IVCODE corresponding to the panel load PLOAD calculated by the load calculation block 151 and the maximum gray level MGRAY determined by the maximum gray detection block 152 among the plurality of initial voltage codes stored in the initial voltage code LUT 157. In one embodiment, for example, as illustrated in FIG. 5, the initial voltage code LUT 157 may store a plurality of initial voltage codes IVCODE11, IVCODE12, . . . , IVCODE1M, IVCODE21, IVCODE22, . . . , IVCODE2M, . . . , IVCODEN1, IVCODEN2, . . . , and IVCODENM respectively corresponding to a plurality of combinations of a plurality of panel loads PLOAD1, PLOAD2, . . . , and PLOADN and a plurality of maximum gray levels MGRAY1, MGRAY2, . . . , and MGRAYM, and the voltage code generation block 154 may read the initial voltage code IVCODE corresponding to a combination of the panel load PLOAD and the maximum gray level MGRAY from the initial voltage code LUT 157.

The step code generation block 155 may determine the step level of the power supply voltage ELVDD based on the panel load PLOAD and the average gray level AGRAY, and may generate the step code SCODE representing the step level corresponding to the panel load PLOAD and the average gray level AGRAY. In an embodiment, the step level of the power supply voltage ELVDD may be increased as the panel load PLOAD increases, and may be increased as the second representative gray level, or the average gray level AGRAY increases.

In an embodiment, the controller 150 may further include a step code lookup table (LUT in FIG. 3) 158 that stores a plurality of step codes corresponding to a plurality of second combinations of the panel loads and average gray levels, and the step code generation block 155 may output the step code SCODE corresponding to the panel load PLOAD calculated by the load calculation block 151 and the average gray level AGRAY calculated by the average gray calculation block 153 among the plurality of step codes stored in the step code LUT 158. In one embodiment, for example, as illustrated in FIG. 6, the step code LUT 158 may store a plurality of step codes SCODE11, SCODE12, . . . , SCODE1M, SCODE21, SCODE22, . . . , SCODE2M, . . . , SCODEN1, SCODEN2, . . . , and SCODENM respectively corresponding to a plurality of combinations of a plurality of panel loads PLOAD1, PLOAD2, . . . , and PLOADN and a plurality of average gray levels AGRAY1, AGRAY2, . . . , and AGRAYM, and the step code generation block 155 may read the step code SCODE corresponding to a combination of the panel load PLOAD and the average gray level AGRAY from the step code LUT 158.

The blank counter block 156 may count clock pulses of a clock signal CLK generated inside or outside the controller 150 during the variable blank period, and may generate the additional voltage code AVCODE that is increased by the step code SCODE each time the counted number of the clock pulses is increased by a predetermined number. In one embodiment, for example, when the counted number of the clock pulses becomes the predetermined number, the blank counter block 156 may increase the additional voltage code AVCODE by the step code SCODE, and may reset the counted number to 0. In such an embodiment, the blank counter block 156 may repeat these operations. Thus, the additional voltage code AVCODE generated by the blank counter block 156 may be increased from an initial value (e.g., a value of 0) periodically (or at a substantially constant interval) by the step code SCODE in the variable blank period. In an embodiment, the blank counter block 156 may initiate a counting operation in response to a blank start signal PRC representing a start of the variable blank period, and may finish the counting operation in response to a frame start signal STV representing a start of the frame period or the active period.

The power supply voltage DAC block 142 of the power management circuit 140 may calculate a sum of the initial voltage code IVCODE and the additional voltage code AVCODE, and may generate an analog voltage AVOLT corresponding to the sum of the initial voltage code IVCODE and the additional voltage code AVCODE. The power supply voltage generation block 144 of the power management circuit 140 may generate the power supply voltage ELVDD corresponding to the analog voltage AVOLT received from the power supply voltage DAC block 142. Thus, since the additional voltage code AVCODE has the initial value (e.g., the value of 0) in the active period, the power management circuit 140 may generate the power supply voltage ELVDD having the initial level represented by the initial voltage code IVCODE in the active period. In such an embodiment, since the additional voltage code AVCODE is periodically increased by the step code SCODE in the variable blank period, the voltage level of the power supply voltage ELVDD generated by the power management circuit 140 may be periodically increased by the step level corresponding to the step code SCODE in the variable blank period. Accordingly, in an embodiment of the OLED display device 100, even if the time length of the variable blank period is changed, or even if the gray levels of the input image data IDAT are changed, the luminance reduction in the variable blank period may be prevented or reduced.

FIG. 7 illustrates an embodiment where the display panel 110 is driven at a driving frequency of about 144 Hz in a first frame period FP1, and is driven at a driving frequency of about 44 Hz in a second frame period FP2. In such an embodiment, the first frame period FP1 and the second frame period FP2 may have active periods AP1 and AP2 having substantially the same time length as each other, but a time length of a variable blank period VBP2 of the second frame period FP2 may be longer than a time length of a variable blank period VBP1 of the first frame period FP1. Accordingly, a luminance reduction 330 of the display panel 110 caused by a leakage current in the variable blank period VBP2 of the second frame period FP2 may be greater than a luminance reduction 310 of the display panel 110 caused by a leakage current in the variable blank period VBP1 of the first frame period FP1. Accordingly, in such an embodiment, the OLED display device 100 may generate the power supply voltage ELVDD having the initial level IL determined by the panel load PLOAD and the maximum gray level MGRAY in each active period AP1 and AP2, and may increase the voltage level of the power supply voltage ELVDD at a substantially constant interval by the step level SL determined by the panel load PLOAD and the average gray level AGRAY in each variable blank period VBP1 and VBP2. Accordingly, in such an embodiment, even if the time length of the variable blank period VBP2 of the second frame period FP2 is increased from the time length of the variable blank period VBP1 of the first frame period FP1, since the voltage level of the power supply voltage ELVDD may be increased step-by-step based on the increased time length of the variable blank period VBP2, the luminance reduction 310 and 330 of the display panel 110 may be prevented or reduced. Thus, in such an embodiment of the OLED display device 100, the display panel 110 may have a substantially constant luminance 350 regardless of the variable input frame frequency VIFF or the variable driving frequency of the display panel 110.

FIG. 8 illustrates an embodiment where the display panel 110 displays a full pattern image having a 255-gray level 255G in a first frame period FP1, and displays a full pattern image having a 64-gray level 64G in a second frame period FP2. In such an embodiment, a luminance reduction 410 of the display panel 110 caused by a leakage current in a variable blank period VBP1 of the first frame period FP1 may be greater than a luminance reduction 450 of the display panel 110 caused by a leakage current in a variable blank period VBP2 of the second frame period FP2. In such an embodiment, the OLED display device 100 may generate the power supply voltage ELVDD having the initial level IL1 and IL2 corresponding to the panel load PLOAD and the maximum gray level MGRAY of the input image data IDAT in a current frame period FP1 and FP2 in each active period AP1 and AP2, and may increase the voltage level of the power supply voltage ELVDD at a substantially constant interval by the step level SL1 and SL2 determined by the panel load PLOAD and the average gray level AGRAY of the input image data IDAT in the current frame period FP1 and FP2 in each variable blank period VBP1 and VBP2. Thus, the step level SL1 in the variable blank period VBP1 of the first frame period FP1 in which the full pattern image having the 255-gray level 255G is displayed may be greater than the step level SL2 in the variable blank period VBP2 of the second frame period FP2 in which the full pattern image having the 64-gray level 64G is displayed. Accordingly, in such an embodiment, even if a gray level of an image displayed in the first frame period FP1 is higher than a gray level of an image displayed in the second frame period FP2, since the step level SL1 in the first frame period FP1 may be greater than the step level SL2 in the second frame period FP2, the luminance reduction 410 and 430 of the display panel 110 in the frame periods FP1 and FP2 in which the images having the different gray levels 255G and 64G are displayed. Thus, in such an embodiment of the OLED display device 100, when the display panel 110 displays an image having any gray level, the display panel 110 may effectively display the image with a desired luminance 430 and 470 corresponding to the gray level.

As described above, in embodiments of the OLED display device 100, the initial level IL of the power supply voltage ELVDD may be determined based on the panel load PLOAD and the maximum gray level MGRAY, the step level SL of the power supply voltage ELVDD may be determined based on the panel load PLOAD and the average gray level AGRAY, and the voltage level of the power supply voltage ELVDD may be gradually increased from the initial level IL based on the step level SL in the variable blank period VBP1 and VBP2. Accordingly, in such embodiments of the OLED display device 100, the luminance reduction in the variable blank period VBP1 and VBP2 may be prevented or reduced.

Figure 9:
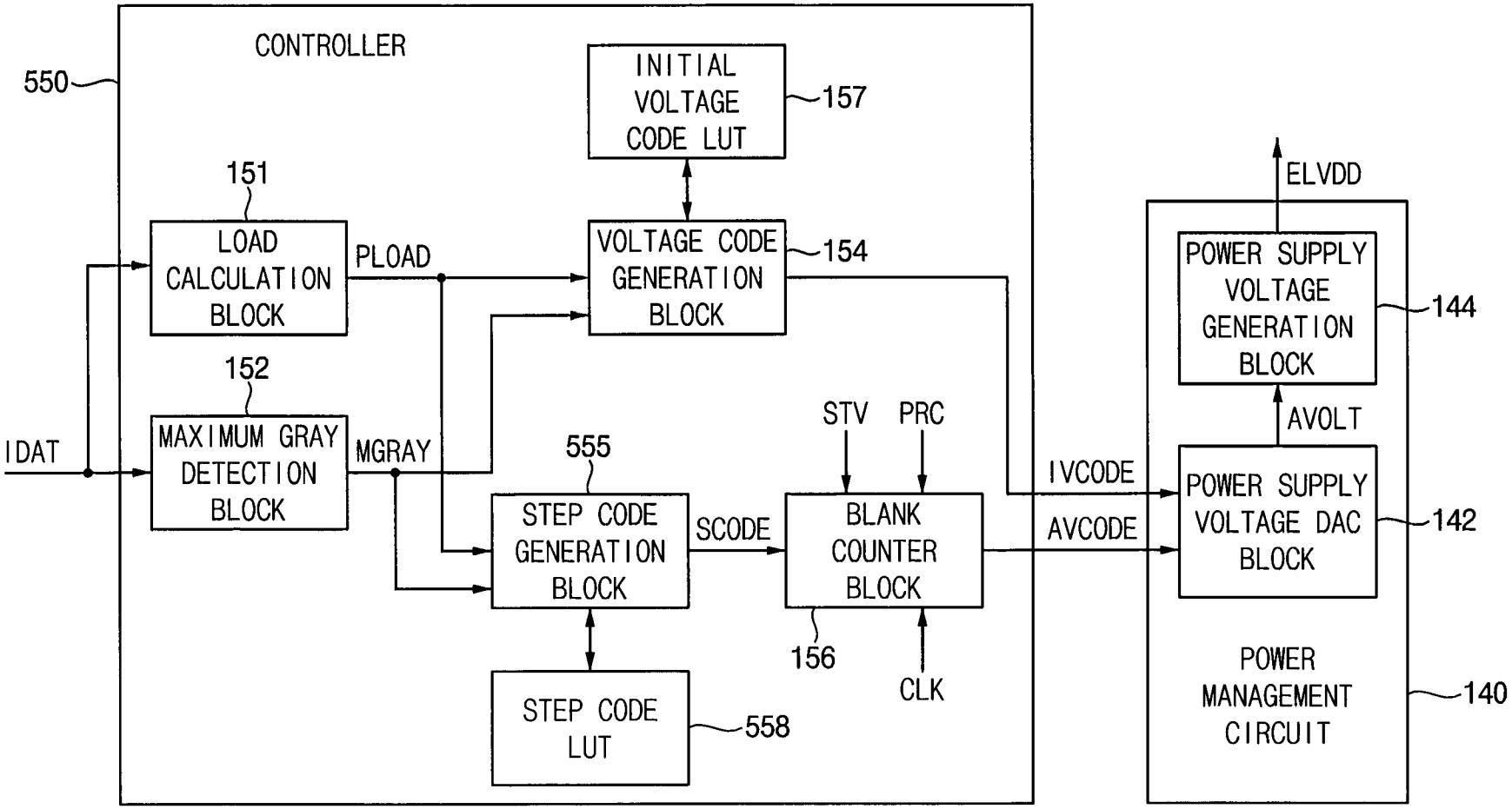
FIG. 9 is a block diagram illustrating a controller and a power management circuit included in an OLED display device according to an alternative embodiment.

FIG. 9 is a block diagram illustrating a controller and a power management circuit included in an OLED display device according to an alternative embodiment, and FIG. 10 is a diagram illustrating an embodiment of a step code lookup table that stores a plurality of step codes corresponding to a plurality of combinations of panel loads and maximum gray levels.

Referring to FIG. 9, in an embodiment of the OLED display device, a controller 550 may include a load calculation block 151, a maximum gray detection block 152, a voltage code generation block 154, a step code generation block 555, a blank counter block 156, an initial voltage code LUT 157 and a step code LUT 558. The controller 550 of FIG. 9 may have same or similar configuration and operation as a controller 150 of FIG. 3, except that the controller 550 may not include an average gray calculation block 153 illustrated in FIG. 3, and the step code generation block 555 may generate a step code SCODE based on a panel load PLOAD and a maximum gray level MGRAY.

The load calculation block 151 may calculate the panel load PLOAD by calculating a ratio of a sum of gray levels of input image data IDAT to a maximum gray level sum, the maximum gray detection block 152 may determine the maximum gray level MGRAY among the gray levels of the input image data IDAT, and the voltage code generation block 154 may generate an initial voltage code IVCODE representing an initial level of a power supply voltage ELVDD corresponding to the panel load PLOAD and the maximum gray level MGRAY.

The step code generation block 555 may determine a step level of the power supply voltage ELVDD based on the panel load PLOAD and the maximum gray level MGRAY, and may generate the step code SCODE representing the step level corresponding to the panel load PLOAD and the maximum gray level MGRAY. The step code LUT 558 may store a plurality of step codes corresponding to a plurality of combinations of panel loads and maximum gray levels, and the step code generation block 555 may output the step code SCODE corresponding to the panel load PLOAD calculated by the load calculation block 151 and the maximum gray level MGRAY determined by the maximum gray detection block 152 among the plurality of step codes stored in the step code LUT 558. In one embodiment, for example, as illustrated in FIG. 10, the step code LUT 558 may store a plurality of step codes SCODE11, SCODE12, . . . , SCODE1M, SCODE21, SCODE22, . . . , SCODE2M, . . . , SCODEN1, SCODEN2, . . . , and SCODENM respectively corresponding to a plurality of combinations of a plurality of panel loads PLOAD1, PLOAD2, . . . , and PLOADN and a plurality of average gray levels MGRAY1, MGRAY2, . . . , and MGRAYM, and the step code generation block 555 may read the step code SCODE corresponding to a combination of the panel load PLOAD and the maximum gray level MGRAY from the step code LUT 558.

The blank counter block 156 may count clock pulses of a clock signal CLK during a variable blank period, and may generate an additional voltage code AVCODE that is increased by the step code SCODE each time the counted number of the clock pulses is increased by a predetermined number.

In such an embodiment, a power supply voltage DAC block 142 of a power management circuit 140 may calculate a sum of the initial voltage code IVCODE and the additional voltage code AVCODE, and may generate an analog voltage AVOLT corresponding to the sum of the initial voltage code IVCODE and the additional voltage code AVCODE. A power supply voltage generation block 144 of the power management circuit 140 may generate the power supply voltage ELVDD corresponding to the analog voltage AVOLT received from the power supply voltage DAC block 142.

As described above, in an embodiment of an OLED display device including the controller 550 of FIG. 9, the initial level of the power supply voltage ELVDD may be determined based on the panel load PLOAD and the maximum gray level MGRAY, the step level of the power supply voltage ELVDD may be determined based on the panel load PLOAD and the maximum gray level MGRAY, and the voltage level of the power supply voltage ELVDD may be gradually increased from the initial level based on the step level during the variable blank period. Accordingly, in such an embodiment of the OLED display device, a luminance reduction in the variable blank period may be prevented or reduced.

Figure 11:
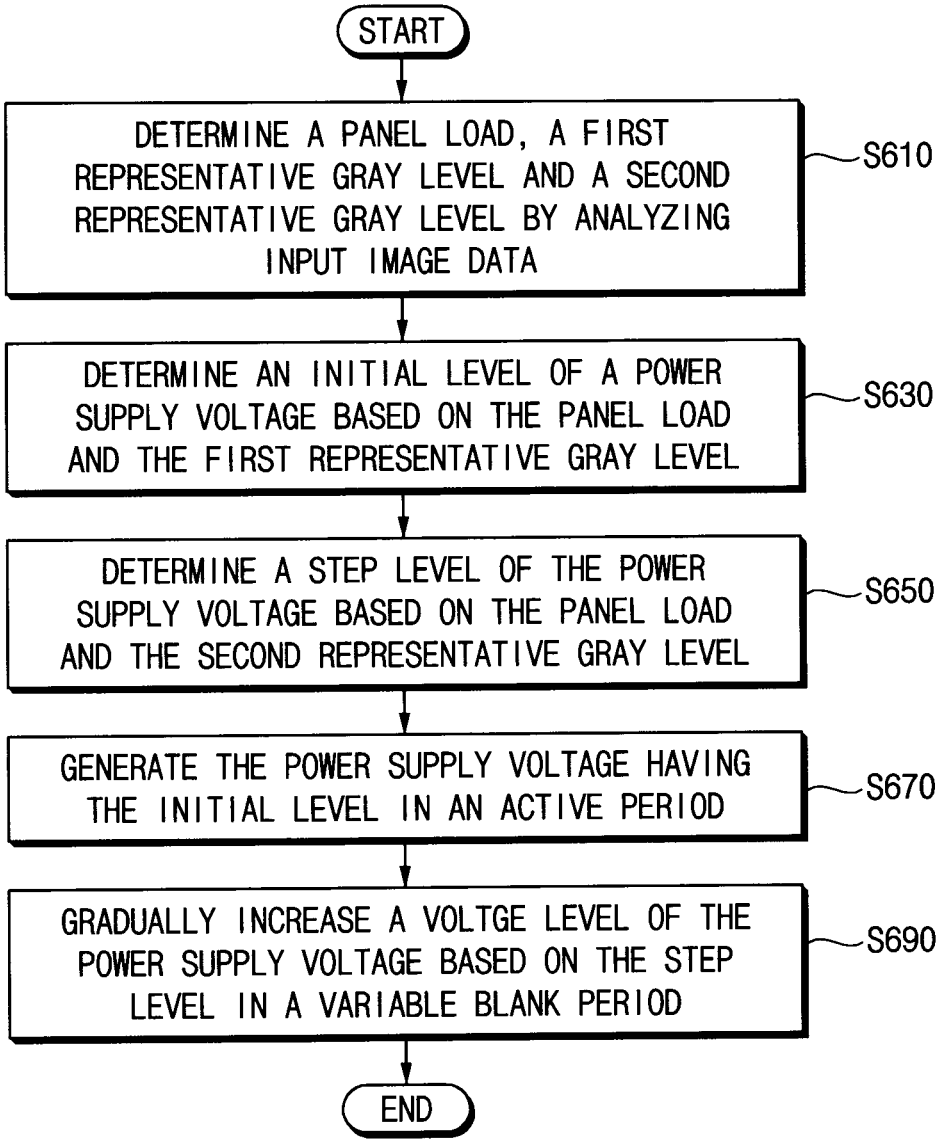
FIG. 11 is a flowchart illustrating a method of operating an OLED display device according to an embodiment.

FIG. 11 is a flowchart illustrating a method of operating an OLED display device according to an embodiment.

Referring to FIGS. 1 and 11, in an embodiment of a method of operating an OLED display device 100 that supports or operates in a variable frame mode in which a frame period includes a variable blank period, a controller 150 may determine a panel load, a first representative gray level and a second representative gray level by analyzing input image data IDAT (S610). In an embodiment, the first representative gray level may be a maximum gray level of the input image data IDAT, and the second representative gray level may be an average gray level of the input image data IDAT. In one embodiment, for example, the OLED display device 100 may calculate the panel load by calculating a ratio of a sum of gray levels of the input image data IDAT to a maximum gray level sum, may determine the maximum gray level among gray levels of the input image data IDAT, and may calculate the average gray level of the gray levels of the input image data IDAT. In an alternative embodiment, each of the first representative gray level and the second representative gray level may be the maximum gray level of the input image data IDAT.

In an embodiment, the OLED display device 100 may determine an initial level of a power supply voltage ELVDD provided to a plurality of pixels PX of a display panel 110 based on the panel load and the first representative gray level (S630). In an embodiment, the initial level of the power supply voltage ELVDD may be increased as the panel load increases, and may be increased as the first representative gray level increases.

In an embodiment, the OLED display device 100 may determine a step level of the power supply voltage ELVDD based on the panel load and the second representative gray level (S650). In an embodiment, the step level of the power supply voltage ELVDD may be increased as the panel load increases, and may be increased as the second representative gray level increases.

In an embodiment, the OLED display device 100 may generate the power supply voltage ELVDD having the initial level during an active period of the frame period (S670), and may gradually increase a voltage level of the power supply voltage ELVDD from the initial level based on the step level during the variable blank period of the frame period (S690). Thus, the voltage level of the power supply voltage ELVDD in the variable blank period may be increased as a time length of the variable blank period increases. In an embodiment, the voltage level of the power supply voltage ELVDD in the variable blank period may be periodically increased by the step level. To periodically increase the voltage level of the power supply voltage ELVDD, the OLED display device 100 may count clock pulses during the variable blank period, and may increase the voltage level of the power supply voltage ELVDD by the step level each time the number of the counted clock pulses is increased by a predetermined number.

As described above, in an embodiment of the method of operating the OLED display device 100, the initial level of the power supply voltage ELVDD may be determined based on the panel load and the first representative gray level, the step level of the power supply voltage ELVDD may be determined based on the panel load PLOAD and the second representative gray level, and the voltage level of the power supply voltage ELVDD may be gradually increased from the initial level based on the step level during the variable blank period. Accordingly, in such an embodiment of the OLED display device 100, a luminance reduction in the variable blank period may be prevented or reduced.

Figure 12:
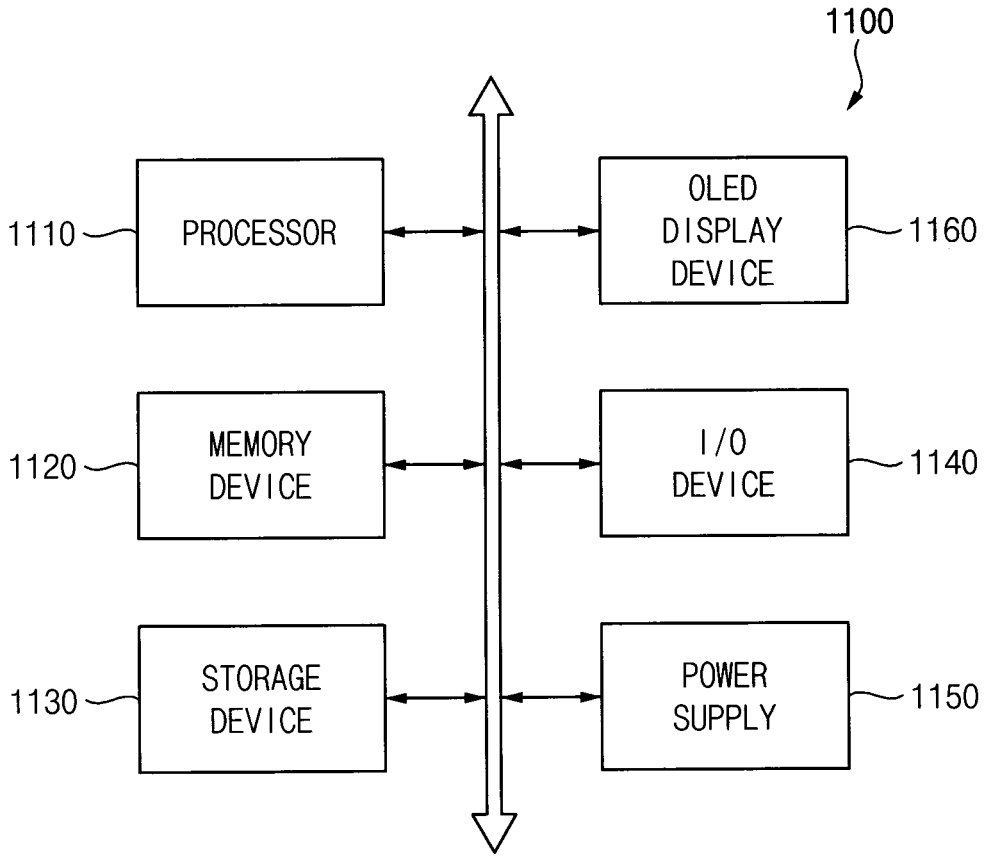
FIG. 12 is a block diagram illustrating an electronic device including an OLED display device according to an embodiment.

FIG. 12 is a block diagram illustrating an electronic device including an OLED display device according to an embodiment.

Referring to FIG. 12, an embodiment of an electronic device 1100 may include a processor 1110, a memory device 1120, a storage device 1130, an input/output ("I/O") device 1140, a power supply 1150, and an OLED display device 1160. The electronic device 1100 may further include a plurality of ports for communicating with a video card, a sound card, a memory card, a universal serial bus ("USB") device, other electric devices, etc.

The processor 1110 may perform various computing functions or tasks. The processor 1110 may be an AP, a micro-processor, a central processing unit ("CPU"), etc. The processor 1110 may be coupled to other components via an address bus, a control bus, a data bus, etc. In an embodiment, the processor 1110 may be further coupled to an extended bus such as a peripheral component interconnection ("PCI") bus.

The memory device 1120 may store data for operations of the electronic device 1100. In one embodiment, for example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile DRAM device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. In such an embodiment, the OLED display device 1160 may be coupled to other components through the buses or other communication links.

In embodiments of the OLED display device 1160, as described herein, an initial level of a power supply voltage supplied to pixels may be determined based on a panel load and a first representative gray level, a step level of the power supply voltage may be determined based on the panel load and a second representative gray level, and a voltage level of the power supply voltage may be gradually increased from the initial level based on the step level in a variable blank period. Accordingly, in such embodiments of the OLED display device 1160, a luminance reduction in the variable blank period may be prevented or reduced.

Embodiments of the invention may be applied to any display device 1160 that supports or operates in the variable frame mode, and any electronic device 1100 including the OLED display device 1160. In one embodiment, for example, the OLED display device 1160 may be applied to a smart phone, a wearable electronic device, a tablet computer, a mobile phone, a television ("TV"), a digital TV, a three-dimensional ("3D") TV, a personal computer ("PC"), a home appliance, a laptop computer, a personal digital assistant ("PDA"), a portable multimedia player ("PMP"), a digital camera, a music player, a portable game console, a navigation device, etc.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. An organic light emitting diode display device which operates in a variable frame mode in which a frame period includes a variable blank period, the organic light emitting diode display device comprising:

a display panel including a plurality of pixels;

a power management circuit which supplies a power supply voltage to the plurality of pixels; and a controller which determines a panel load, a first representative gray level and a second representative gray level by analyzing input image data, determines an initial level of the power supply voltage based on the panel load and the first representative gray level, and determines a step level of the power supply voltage based on the panel load and the second representative gray level, wherein the power management circuit generates the power supply voltage having the initial level during an active period of the frame period, and gradually increases a voltage level of the power supply voltage from the initial level based on the step level during the variable blank period of the frame period.

2. The organic light emitting diode display device of claim 1, wherein the voltage level of the power supply voltage in the variable blank period is increased as a time length of the variable blank period increases.

3. The organic light emitting diode display device of claim 1, wherein the voltage level of the power supply voltage in the variable blank period is periodically increased by the step level.

4. The organic light emitting diode display device of claim 1, wherein the initial level of the power supply voltage is increased as the panel load increases, and is increased as the first representative gray level increases.

5. The organic light emitting diode display device of claim 1, wherein the step level of the power supply voltage is increased as the panel load increases, and is increased as the second representative gray level increases.

6. The organic light emitting diode display device of claim 1, wherein the controller generates an initial voltage code representing the initial level of the power supply voltage and a step code representing the step level of the power supply voltage, and generates an additional voltage code which has an initial value in the active period and periodically increases by the step code during the variable blank period, and wherein the power management circuit receives the initial voltage code and the additional voltage code from the controller, and generates the power supply voltage having the voltage level corresponding to a sum of the initial voltage code and the additional voltage code.

7. The organic light emitting diode display device of claim 1, wherein the first representative gray level is a maximum gray level of the input image data, and wherein the second representative gray level is an average gray level of the input image data.

8. The organic light emitting diode display device of claim 7, wherein the controller includes:

a load calculation block which calculates the panel load by calculating a ratio of a sum of gray levels of the input image data to a maximum gray level sum;

a maximum gray detection block which determines the maximum gray level among the gray levels of the input image data;

an average gray calculation block which calculates the average gray level of the gray levels of the input image data;

a voltage code generation block which generate san initial voltage code representing the initial level corresponding to the panel load and the maximum gray level;

a step code generation block which generates a step code representing the step level corresponding to the panel load and the average gray level; and a blank counter block which counts clock pulses during the variable blank period, and generates an additional voltage code which is increased by the step code each time when a number of the counted clock pulses is increased by a predetermined number.

9. The organic light emitting diode display device of claim 8, wherein the controller further includes:

an initial voltage code lookup table which stores a plurality of initial voltage codes corresponding to a plurality of first combinations of panel loads and maximum gray levels; and a step code lookup table which stores a plurality of step codes corresponding to a plurality of second combinations of the panel loads and average gray levels, wherein the voltage code generation block outputs the initial voltage code corresponding to the panel load calculated by the load calculation block and the maximum gray level determined by the maximum gray detection block among the plurality of initial voltage codes stored in the initial voltage code lookup table, and wherein the step code generation block outputs the step code corresponding to the panel load calculated by the load calculation block and the average gray level calculated by the average gray calculation block among the plurality of step codes stored in the step code lookup table.

10. The organic light emitting diode display device of claim 8, wherein the power management circuit includes:

a power supply voltage digital-to-analog converter block which calculates a sum of the initial voltage code and the additional voltage code, and generates an analog voltage corresponding to the sum of the initial voltage code and the additional voltage code; and a power supply voltage generation block which generates the power supply voltage based on the analog voltage received from the power supply voltage digital-to-analog converter block.

11. The organic light emitting diode display device of claim 1, wherein each of the first representative gray level and the second representative gray level is a maximum gray level of the input image data.

12. The organic light emitting diode display device of claim 11, wherein the controller includes:

a load calculation block which calculates the panel load by calculating a ratio of a sum of gray levels of the input image data to a maximum gray level sum;

a maximum gray detection block which determines the maximum gray level among the gray levels of the input image data;

a voltage code generation block which generates an initial voltage code representing the initial level corresponding to the panel load and the maximum gray level;

a step code generation block which generates a step code representing the step level corresponding to the panel load and the maximum gray level; and a blank counter block which counts clock pulses during the variable blank period, and generates an additional voltage code which is increased by the step code each time when a number of the counted clock pulses is increased by a predetermined number.

13. The organic light emitting diode display device of claim 12, wherein the controller further includes:

an initial voltage code lookup table which stores a plurality of initial voltage codes corresponding to a plurality of first combinations of panel loads and maximum gray levels; and a step code lookup table which stores a plurality of step codes corresponding to a plurality of second combinations of the panel loads and the maximum gray levels, wherein the voltage code generation block outputs the initial voltage code corresponding to the panel load calculated by the load calculation block and the maximum gray level determined by the maximum gray detection block among the plurality of initial voltage codes stored in the initial voltage code lookup table, and wherein the step code generation block outputs the step code corresponding to the panel load calculated by the load calculation block and the maximum gray level determined by the maximum gray detection block among the plurality of step codes stored in the step code lookup table.

14. A method of operating an organic light emitting diode display device which operates a variable frame mode in which a frame period includes a variable blank period, the method comprising:

determining a panel load, a first representative gray level and a second representative gray level by analyzing input image data;

determining an initial level of a power supply voltage, which is provided to a plurality of pixels of a display panel, based on the panel load and the first representative gray level;

determining a step level of the power supply voltage based on the panel load and the second representative gray level;

generating the power supply voltage having the initial level during an active period of the frame period; and gradually increasing a voltage level of the power supply voltage from the initial level based on the step level during the variable blank period of the frame period.

15. The method of claim 14, wherein the voltage level of the power supply voltage in the variable blank period is increased as a time length of the variable blank period increases.

16. The method of claim 14, wherein the voltage level of the power supply voltage in the variable blank period is periodically increased by the step level.

17. The method of claim 14, wherein the gradually increasing the voltage level of the power supply voltage includes counting clock pulses during the variable blank period; and increasing the voltage level of the power supply voltage by the step level each time when a number of the counted clock pulses is increased by a predetermined number.

18. The method of claim 14, wherein the initial level of the power supply voltage is increased as the panel load increases, and is increased as the first representative gray level increases.

19. The method of claim 14, wherein the step level of the power supply voltage is increased as the panel load increases, and is increased as the second representative gray level increases.

20. The method of claim 14, wherein the first representative gray level is a maximum gray level of the input image data, and wherein the second representative gray level is an average gray level of the input image data.

* * * * *